US008889612B2

(12) United States Patent
Boutique et al.

(10) Patent No.: US 8,889,612 B2
(45) **Date of Patent: *Nov. 18, 2014**

(54) METHOD OF LAUNDERING FABRIC USING A COMPACTED LIQUID LAUNDRY DETERGENT COMPOSITION

(75) Inventors: Jean-Pol Boutique, Gembloux (BE); Stephen Joseph Hodson, Mason, OH (US)

(73) Assignee: The Procter & Gamble Company, Cincinnati, OH (US)

( * ) Notice: Subject to any disclaimer, the term of this patent is extended or adjusted under 35 U.S.C. 154(b) by 509 days.

This patent is subject to a terminal disclaimer.

(21) Appl. No.: 13/084,845

(22) Filed: Apr. 12, 2011

(65) Prior Publication Data

US 2011/0252576 A1 Oct. 20, 2011

Related U.S. Application Data

(60) Provisional application No. 61/325,429, filed on Apr. 19, 2010.

(51) Int. Cl.

| | |
|---|---|
| ***C11D 3/00*** | (2006.01) |
| ***C11D 3/20*** | (2006.01) |
| ***C11D 1/83*** | (2006.01) |
| ***C11D 3/37*** | (2006.01) |
| ***C11D 3/386*** | (2006.01) |

(52) U.S. Cl.

CPC ..... *C11D 3/373* (2013.01); *C11D 3/2079* (2013.01); *C11D 1/83* (2013.01); *C11D 3/386* (2013.01)

USPC ..... 510/320; 510/311; 510/321; 510/376; 510/393; 510/509; 8/137

(58) Field of Classification Search

USPC ..... 510/218, 108, 276, 445, 311, 320–321, 510/376, 393, 509; 8/137

See application file for complete search history.

(56) References Cited

U.S. PATENT DOCUMENTS

| | | | | | |
|---|---|---|---|---|---|
| 4,123,370 | A * | 10/1978 | Meinhardt | 508/369 |
| 4,202,800 | A * | 5/1980 | Ciko et al. | 510/325 |
| 4,263,179 | A * | 4/1981 | Schmolka | 510/340 |
| 4,717,507 | A * | 1/1988 | Schwadtke et al. | 510/321 |
| 6,362,156 | B1 * | 3/2002 | Hsu et al. | 510/418 |
| 7,361,736 | B2 * | 4/2008 | Schnorr et al. | 530/350 |
| 8,211,848 | B2 * | 7/2012 | Dykstra et al. | 510/311 |
| 2006/0234895 | A1 * | 10/2006 | Souter et al. | 510/386 |
| 2009/0217464 | A1 * | 9/2009 | Souter et al. | 8/137 |
| 2011/0306556 | A1 * | 12/2011 | Dawson-Scully et al. | 514/17.7 |

FOREIGN PATENT DOCUMENTS

| | | | |
|---|---|---|---|
| GB | 2 388 610 | A | 11/2003 |
| WO | WO 00/27958 | * | 5/2000 |
| WO | WO 00/63340 | A1 | 10/2000 |
| WO | WO 2006/130442 | * | 12/2006 |
| WO | WO 2007/130562 | A2 | 11/2007 |

OTHER PUBLICATIONS

International Search Report, dated Aug. 17, 2011, containing 6 pages.

* cited by examiner

*Primary Examiner* — Hannah Pak

(74) *Attorney, Agent, or Firm* — Gregory S. Darley-Emerson; Steven W. Miller

(57) ABSTRACT

A method of laundering fabric including the step of contacting a liquid laundry detergent composition to water to form a wash liquor, and laundering fabric in the wash liquor, wherein the laundry detergent is contacted to water in such an amount so that the concentration of the laundry detergent composition in the wash liquor is from above 0 g/l to 4 g/l, and wherein from 0.01 kg to 2 kg of fabric per liter of wash liquor is dosed into the wash liquor, and wherein the liquid laundry detergent composition comprises: (i) detersive surfactant; (ii) surfactancy boosting polymer; (iii) from 0 wt % to 10 wt % fatty acid; (iv) silicone suds suppressor; (v) structurant; (vi) enzyme; and (vii) nil-boron enzyme stabilizer; wherein the electrolytic strength of the composition at a concentration of 1 g/l in de-ionized water and at a temperature of 25° C. in $mScm^{-1}$ is less than 200 $mScm^{-1}$.

15 Claims, No Drawings

METHOD OF LAUNDERING FABRIC USING A COMPACTED LIQUID LAUNDRY DETERGENT COMPOSITION

CROSS REFERENCE TO RELATED APPLICATION

This application claims the benefit of U.S. Provisional Application No. 61/325,429, filed 19 Apr. 2010.

FIELD OF THE INVENTION

The present invention relates to a method of laundering fabric using a compacted liquid laundry detergent composition. Such liquid laundry detergent compositions comprise: (i) detersive surfactant comprising anionic detersive surfactant and non-ionic surfactant, wherein the weight ratio of anionic detersive surfactant to non-ionic detersive surfactant is greater than 1:1; (ii) surfactancy boosting polymer; (iii) from 0 wt % to 10 wt % fatty acid; (iv) silicone suds suppressor; (v) structurant; (vi) enzyme; and (vii) nil-boron enzyme stabilizer.

BACKGROUND OF THE INVENTION

Recent liquid laundry detergent consumer preferences towards smaller more concentrated product forms, colder wash temperatures and shorter wash times have resulted in the liquid detergent formulators handling a whole series of different constraints. In addition, not only do consumers want smaller compacted liquid laundry detergent products to use at these lower wash temperatures and shorter wash times, but the consumers also want these compacted products to have the same performance as traditional uncompacted liquid laundry detergents have at higher wash temperatures and during longer wash cycles; this is an extremely difficult consumer need to meet.

Compacted liquid laundry detergent products have less space to incorporate detergent ingredients; this places great constraint on the detergent formulator, especially for restricting the levels of the bulk detergent ingredients like surfactants, builders and solvents that take up much of the formulation space. For the detergent ingredients that are incorporated into these compacted liquid laundry detergent products, the detergent formulator must greatly improve the efficiency of these detergent ingredients, and of the compacted liquid laundry detergent composition as a whole.

As well as ensures such compacted liquid laundry detergents have good cleaning performance, the detergent formulator must also ensure that such products have good sudsing profile, have good product storage stability profile, and desirable rheological properties to ensure that the product can be processed, and handled and dosed easily by the consumer.

The Inventors have overcome these problems by providing a method for laundering fabric, wherein the detersive surfactant and polymer systems are optimized and the enzyme system is optimized to provide good cleaning performance, especially good dingy cleaning, whiteness and stain removal performance, when used in a compacted liquid laundry detergent composition, even at low washing temperatures, and even during very short washing cycles. These products also have good product stability, good sudsing profile, and have excellent rheology profiles.

SUMMARY OF THE INVENTION

The present invention relates to a method of laundering fabric comprising the step of contacting a liquid laundry detergent composition to water to form a wash liquor, and laundering fabric in said wash liquor, wherein the laundry detergent is contacted to water in such an amount so that the concentration of the laundry detergent composition in the wash liquor is from above 0 g/l to 4 g/l, and wherein from 0.01 kg to 2 kg of fabric per liter of wash liquor is dosed into said wash liquor, and wherein the liquid laundry detergent composition comprises:

(i) detersive surfactant comprising anionic detersive surfactant and non-ionic surfactant, wherein the weight ratio of anionic detersive surfactant to non-ionic detersive surfactant is greater than 1:1;
(ii) surfactancy boosting polymer;
(iii) from 0 wt % to 10 wt % fatty acid;
(iv) silicone suds suppressor;
(v) structurant;
(vi) enzyme; and
(vii) nil-boron enzyme stabilizer;

wherein the electrolytic strength of the composition at a concentration of 1 g/l in de-ionized water and at a temperature of 25° C. in $mScm^{-1}$ is less than 200 $mScm^{-1}$.

DETAILED DESCRIPTION OF THE INVENTION

Method of Laundering Fabric.

The method of laundering fabric comprises the step of contacting a liquid laundry detergent composition to water to form a wash liquor, and laundering fabric in said wash liquor. The liquid laundry detergent composition is described in more detail below. The fabric may be contacted to the water prior to, or after, or simultaneous with, contacting the laundry detergent composition with water.

Typically, the wash liquor is formed by contacting the laundry detergent to water in such an amount so that the concentration of laundry detergent composition in the wash liquor is from above 0 g/l to 4 g/l, preferably from 1 g/l, and preferably to 3.5 g/l, or to 3.0 g/l, or to 2.5 g/l, or to 2.0 g/l, or to 1.5 g/l, or even to 1.0 g/l, or even to 0.5 g/l.

Highly preferably, the method of laundering fabric is carried out in a front-loading automatic washing machine. In this embodiment, the wash liquor formed and concentration of laundry detergent composition in the wash liquor is that of the main wash cycle. Any input of water during any optional rinsing step(s) that typically occurs when laundering fabric using a front-loading automatic washing machine is not included when determining the volume of the wash liquor. Of course, any suitable automatic washing machine may be used, although it is extremely highly preferred that a front-loading automatic washing machine is used.

It is highly preferred for the wash liquor to comprise 40 liters or less of water, preferably 35 liters or less, preferably 30 liters or less, preferably 25 liters or less, preferably 20 liters or less, preferably 15 liters or less, preferably 12 liters or less, preferably 10 liters or less, preferably 8 liters or less, or even 6 liters or less of water. Preferably, the wash liquor comprises from above 0 to 15 liters, or from 1 liter, or from 2 liters, or from 3 liters, and preferably to 12 liters, or to 10 liters, or even to 8 liters of water. Most preferably, the wash liquor comprises from 1 liter, or from 2 liters, or from 3 liters, or from 4 liters, or even from 5 liters of water.

Typically from 0.01 kg to 2 kg of fabric per liter of wash liquor is dosed into said wash liquor. Typically from 0.01 kg, or from 0.02 kg, or from 0.03 kg, or from 0.05 kg, or from 0.07 kg, or from 0.10 kg, or from 0.12 kg, or from 0.15 kg, or from 0.18 kg, or from 0.20 kg, or from 0.22 kg, or from 0.25 kg fabric per liter of wash liquor is dosed into said wash liquor.

Preferably 50 g or less, more preferably 45 g or less, or 40 g or less, or 35 g or less, or 30 g or less, or 25 g or less, or 20 g or less, or even 15 g or less, or even 10 g or less of laundry detergent composition is contacted to water to form the wash liquor.

Preferably, the laundry detergent composition is contacted to from above 0 liters, preferably from above 1 liter, and preferably to 70 liters or less of water to form the wash liquor, or preferably to 40 liters or less of water, or preferably to 35 liters or less, or preferably to 30 liters or less, or preferably to 25 liters or less, or preferably to 20 liters or less, or preferably to 15 liters or less, or preferably to 12 liters or less, or preferably to 10 liters or less, or preferably to 8 liters or less, or even to 6 liters or less of water to form the wash liquor.

Typically, the fabric is laundered in said wash liquor at a temperature of 30° C. or less, preferably 25° C. or less, or 20° C. or less, or even 15° C. or less, or even 10° C. or less.

Liquid Laundry Detergent Composition.

The composition can be any liquid form, for example a liquid or gel form, or any combination thereof. The composition may be in any unit dose form, for example a pouch. However, it is extremely highly preferred for the composition to be in gel form.

The composition is a fully finished laundry detergent composition. The composition is not just a component of a laundry detergent composition that can be incorporated into a laundry detergent composition, it is a fully finished laundry detergent composition. That said, it is within the scope of the present invention for an additional rinse additive composition (e.g. fabric conditioner or enhancer), or a main wash additive composition (e.g. bleach additive) to also be used in combination with the liquid laundry detergent composition during the method of the present invention. Although, it may be preferred for no bleach additive composition is used in combination with the laundry detergent composition during the method of the present invention.

The liquid laundry detergent composition comprises: (i) detersive surfactant comprising anionic detersive surfactant and non-ionic surfactant, wherein the weight ratio of anionic detersive surfactant to non-ionic detersive surfactant is greater than 1:1; (ii) surfactancy boosting polymer; (iii) from 0 wt % to 10 wt % fatty acid; (iv) silicone suds suppressor; (v) structurant; (vi) enzymes; and (vii) nil-boron enzyme stabilizer. The electrolytic strength of the composition at a concentration of 1 g/l in de-ionized water and at a temperature of 25° C. in $mScm^{-1}$ is preferably less than 200 $mScm^{-1}$. It may be preferred to keep low levels of fatty acid in the composition, and/or to use alkanolamines, preferably tertiary alkanolamines having a pKa of less than 9.0, or even less than 8.0, preferred are tri-isopropanolamine (TIPA), and/or triethanolamine (TEA), especially preferred is TEA due to its low molecular weight and low pKa, to provide some buffering capacity in the formulation.

Preferably, the composition comprises: (i) detersive surfactant comprising anionic detersive surfactant and non-ionic surfactant, wherein the weight ratio of anionic detersive surfactant to non-ionic detersive surfactant is greater than 1:1; and optionally wherein the anionic detersive surfactant has a hydrophilic index ($HI_C$) of from 8.0 to 9.1; (ii) surfactancy boosting polymer; (iii) from 0 wt % to 5 wt % fatty acid; (iv) silicone suds suppressor; (v) structurant; (vi) enzymes; and (vii) non-boron enzyme stabilizer; and wherein the electrolytic strength of the composition at a concentration of 1 g/l in de-ionized water and at a temperature of 25° C. in $mScm^{-1}$ is preferably less than 200 $mScm^{-1}$.

Detersive Surfactant.

The detersive surfactant typically comprises anionic detersive surfactant and non-ionic surfactant, wherein preferably the weight ratio of anionic detersive surfactant to non-ionic detersive surfactant is greater than 1:1, preferably greater than 1.5:1, or even greater than 2:1, or even greater than 2.5:1, or greater than 3:1.

The composition preferably comprises detersive surfactant, preferably from 10 wt % to 40 wt %, preferably from 12 wt %, or from 15 wt %, or even from 18 wt % detersive surfactant. Preferably, the surfactant comprises alkyl benzene sulphonate and one or more detersive co-surfactants. The surfactant preferably comprises $C_{10}$-$C_{13}$ alkyl benzene sulphonate and one or more co-surfactants. The co-surfactants preferably are selected from the group consisting of $C_{12}$-$C_{18}$ alkyl ethoxylated alcohols, preferably having an average degree of ethoxylation of from 1 to 7; $C_{12}$-$C_{18}$ alkyl ethoxylated sulphates, preferably having an average degree of ethoxylation of from 1 to 5; and mixtures thereof. However, other surfactant systems may be suitable for use in the present invention.

Suitable detersive surfactants include anionic detersive surfactants, nonionic detersive surfactants, cationic detersive surfactants, zwitterionic detersive surfactants, amphoteric detersive surfactants and mixtures thereof.

Suitable anionic detersive surfactants include: alkyl sulphates; alkyl sulphonates; alkyl phosphates; alkyl phosphonates; alkyl carboxylates; and mixtures thereof. The anionic surfactant can be selected from the group consisting of: $C_{10}$-$C_{18}$ alkyl benzene sulphonates (LAS) preferably $C_{10}$-$C_{13}$ alkyl benzene sulphonates; $C_{10}$-$C_{20}$ primary, branched chain, linear-chain and random-chain alkyl sulphates (AS), typically having the following formula:

$$CH_3(CH_2)xCH_2—OSO_3^-M^+$$

wherein, M is hydrogen or a cation which provides charge neutrality, preferred cations are sodium and ammonium cations, wherein x is an integer of at least 7, preferably at least 9; $C_{10}$-$C_{18}$ secondary (2,3) alkyl sulphates, typically having the following formulae:

$$CH_3(CH_2)_x\overset{\overset{\displaystyle OSO_3^-M^+}{|}}{(CH)}CH_3 \quad \text{or} \quad CH_3(CH_2)_y\overset{\overset{\displaystyle OSO_3^-M^+}{|}}{(CH)}CH_2CH_3$$

wherein, M is hydrogen or a cation which provides charge neutrality, preferred cations include sodium and ammonium cations, wherein x is an integer of at least 7, preferably at least 9, y is an integer of at least 8, preferably at least 9; $C_{10}$-$C_{18}$ alkyl alkoxy carboxylates; mid-chain branched alkyl sulphates as described in more detail in U.S. Pat. No. 6,020,303 and U.S. Pat. No. 6,060,443; modified alkylbenzene sulphonate (MLAS) as described in more detail in WO 99/05243, WO 99/05242, WO 99/05244, WO 99/05082, WO 99/05084, WO 99/05241, WO 99/07656, WO 00/23549, and WO 00/23548; methyl ester sulphonate (MES); alpha-olefin sulphonate (AOS) and mixtures thereof.

Preferred anionic detersive surfactants include: linear or branched, substituted or unsubstituted alkyl benzene sulphonate detersive surfactants, preferably linear $C_8$-$C_{18}$ alkyl benzene sulphonate detersive surfactants; linear or branched, substituted or unsubstituted alkyl benzene sulphate detersive surfactants; linear or branched, substituted or unsubstituted alkyl sulphate detersive surfactants, including linear $C_8$-$C_{18}$ alkyl sulphate detersive surfactants, $C_1$-$C_3$ alkyl branched $C_8$-$C_{18}$ alkyl sulphate detersive surfactants, linear or branched alkoxylated $C_8$-$C_{18}$ alkyl sulphate detersive surfactants and mixtures thereof; linear or branched, substituted or unsubstituted alkyl sulphonate detersive surfactants; and mixtures thereof.

Preferred alkoxylated alkyl sulphate detersive surfactants are linear or branched, substituted or unsubstituted $C_{8-18}$ alkyl alkoxylated sulphate detersive surfactants having an average degree of alkoxylation of from 1 to 30, preferably from 1 to 10. Preferably, the alkoxylated alkyl sulphate detersive surfactant is a linear or branched, substituted or unsubstituted $C_{8-18}$ alkyl ethoxylated sulphate having an average degree of ethoxylation of from 1 to 10. Most preferably, the alkoxylated alkyl sulphate detersive surfactant is a linear unsubstituted $C_{8-18}$ alkyl ethoxylated sulphate having an average degree of ethoxylation of from 3 to 7.

Preferred anionic detersive surfactants are selected from the group consisting of: linear or branched, substituted or unsubstituted, $C_{12-18}$ alkyl sulphates; linear or branched, substituted or unsubstituted, $C_{10-13}$ alkylbenzene sulphonates, preferably linear $C_{10-13}$ alkylbenzene sulphonates; and mixtures thereof. Highly preferred are linear $C_{10-13}$ alkylbenzene sulphonates. Highly preferred are linear $C_{10-13}$ alkylbenzene sulphonates that are obtainable, preferably obtained, by sulphonating commercially available linear alkyl benzenes (LAB); suitable LAB include low 2-phenyl LAB, such as those supplied by Sasol under the tradename Isochem® or those supplied by Petresa under the tradename Petrelab®, other suitable LAB include high 2-phenyl LAB, such as those supplied by Sasol under the tradename Hyblene®. A suitable anionic detersive surfactant is alkyl benzene sulphonate that is obtained by DETAL catalyzed process, although other synthesis routes, such as HF, may also be suitable.

Another suitable anionic detersive surfactant is alkyl ethoxy carboxylate. The anionic detersive surfactants are typically present in their salt form, typically being complexed with a suitable cation. Suitable counter-ions include $Na^+$ and $K^+$, substituted ammonium such as $C_1$-$C_6$ alkanolammonium preferably mono-ethanolamine (MEA) tri-ethanolamine (TEA), di-ethanolamine (DEA), and any mixtures thereof.

However, preferably at least 20 wt %, or at least 30 wt %, or at least 40 wt %, or at least 50 wt %, or at least 60 wt %, or at least 70 wt %, or at least 80 wt %, or even or at least 90 wt % of the anionic detersive surfactant is neutralized by a sodium cation.

It may also be preferred for the anionic detersive surfactant to have a hydrophilic index ($HI_C$) of from 8.0 to 9.1, or it may even be preferred for the anionic detersive surfactant to have a lower hydrophilic index ($HI_C$), such as one in the range of from 6.0 to 8.0, or from 7.0 to below 8.0. The hydrophilic index ($HI_C$) is described in more detail in WO00/27958.

Suitable cationic detersive surfactants include: alkyl pyridinium compounds; alkyl quaternary ammonium compounds; alkyl quaternary phosphonium compounds; alkyl ternary sulphonium compounds; and mixtures thereof. The cationic detersive surfactant can be selected from the group consisting of: alkoxylate quaternary ammonium (AQA) surfactants as described in more detail in U.S. Pat. No. 6,136,769; dimethyl hydroxyethyl quaternary ammonium as described in more detail in U.S. Pat. No. 6,004,922; polyamine cationic surfactants as described in more detail in WO 98/35002, WO 98/35003, WO 98/35004, WO 98/35005, and WO 98/35006; cationic ester surfactants as described in more detail in U.S. Pat. No. 4,228,042, U.S. Pat. No. 4,239,660, U.S. Pat. No. 4,260,529 and U.S. Pat. No. 6,022,844; amino surfactants as described in more detail in U.S. Pat. No. 6,221,825 and WO 00/47708, specifically amido propyldimethyl amine; and mixtures thereof. Preferred cationic detersive surfactants are quaternary ammonium compounds having the general formula:

$$(R)(R_1)(R_2)(R_3)N^+X^-$$

wherein, R is a linear or branched, substituted or unsubstituted $C_{6-18}$ alkyl or alkenyl moiety, $R_1$ and $R_2$ are independently selected from methyl or ethyl moieties, $R_3$ is a hydroxyl, hydroxymethyl or a hydroxyethyl moiety, X is an anion which provides charge neutrality, preferred anions include halides (such as chloride), sulphate and sulphonate. Preferred cationic detersive surfactants are mono-$C_{6-18}$ alkyl mono-hydroxyethyl di-methyl quaternary ammonium chlorides. Highly preferred cationic detersive surfactants are mono-$C_{8-10}$ alkyl mono-hydroxyethyl di-methyl quaternary ammonium chloride, mono-$C_{10-12}$ alkyl mono-hydroxyethyl di-methyl quaternary ammonium chloride and mono-$C_{10}$ alkyl mono-hydroxyethyl di-methyl quaternary ammonium chloride.

Suitable non-ionic detersive surfactant can be selected from the group consisting of: $C_8$-$C_{18}$ alkyl ethoxylates, such as, NEODOL® non-ionic surfactants from Shell; $C_6$-$C_{12}$ alkyl phenol alkoxylates wherein the alkoxylate units are ethyleneoxy units, propyleneoxy units or a mixture thereof; $C_{12}$-$C_{18}$ alcohol and $C_6$-$C_{12}$ alkyl phenol condensates with ethylene oxide/propylene oxide block polymers such as Pluronic® from BASF; $C_{14}$-$C_{22}$ mid-chain branched alcohols, BA, as described in more detail in U.S. Pat. No. 6,150,322; $C_{14}$-$C_{22}$ mid-chain branched alkyl alkoxylates, BAEx, wherein x=from 1 to 30, as described in more detail in U.S. Pat. No. 6,153,577, U.S. Pat. No. 6,020,303 and U.S. Pat. No. 6,093,856; alkylpolysaccharides as described in more detail in U.S. Pat. No. 4,565,647, specifically alkylpolyglycosides as described in more detail in U.S. Pat. No. 4,483,780 and U.S. Pat. No. 4,483,779; polyhydroxy fatty acid amides as described in more detail in U.S. Pat. No. 5,332,528, WO 92/06162, WO 93/19146, WO 93/19038, and WO 94/09099; ether capped poly(oxyalkylated) alcohol surfactants as described in more detail in U.S. Pat. No. 6,482,994 and WO 01/42408; and mixtures thereof.

The non-ionic detersive surfactant could be an alkyl polyglucoside and/or an alkyl alkoxylated alcohol. Preferably the non-ionic detersive surfactant is a linear or branched, substituted or unsubstituted $C_{8-18}$ alkyl ethoxylated alcohol having an average degree of ethoxylation of from 1 to 10, more preferably from 3 to 7.

Suitable zwitterionic and/or amphoteric detersive surfactants include alkanolamine sulpho-betaines.

It may be preferred for the composition to comprise branched anionic detersive surfactant and/or branched non-ionic detersive surfactant. Preferably, the branched anionic detersive surfactant and/or branched non-ionic detersive surfactant are derived from natural sources, preferably wherein the natural sources include bio-derived isoprenoids, most preferably farnescene.

Surfactancy Boosting Polymer.

The composition may comprise a surfactancy boosting polymer. Preferred polymers are amphiphilic alkoxylated grease cleaning polymers and/or random graft co-polymers. These polymers are described in more detail below.

Amphiphilic Alkoxylated Grease Cleaning Polymer.

Amphiphilic alkoxylated grease cleaning polymers refer to any alkoxylated polymers having balanced hydrophilic and hydrophobic properties such that they remove grease particles from fabrics and surfaces. Specific embodiments of the amphiphilic alkoxylated grease cleaning polymers of the present invention comprise a core structure and a plurality of alkoxylate groups attached to that core structure.

The core structure may comprise a polyalkylenimine structure comprising, in condensed form, repeating units of formulae (I), (II), (III) and (IV):

(I)

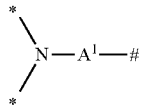

(II)

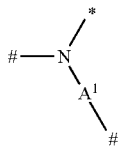

(III)

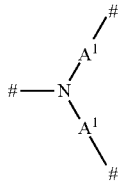

(IV)

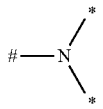

wherein # in each case denotes one-half of a bond between a nitrogen atom and the free binding position of a group $A^1$ of two adjacent repeating units of formulae (I), (II), (III) or (IV); * in each case denotes one-half of a bond to one of the alkoxylate groups; and $A^1$ is independently selected from linear or branched $C_2$-$C_6$-alkylene; wherein the polyalkylenimine structure consists of 1 repeating unit of formula (I), x repeating units of formula (II), y repeating units of formula (III) and y+1 repeating units of formula (IV), wherein x and y in each case have a value in the range of from 0 to about 150; where the average weight average molecular weight, Mw, of the polyalkylenimine core structure is a value in the range of from about 60 to about 10,000 g/mol.

The core structure may alternatively comprise a polyalkanolamine structure of the condensation products of at least one compound selected from N-(hydroxyalkyl)amines of formulae (I.a) and/or (I.b), (I.a)

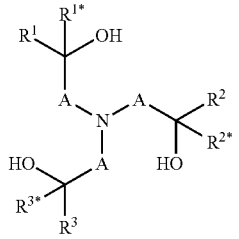

-continued (I.b)

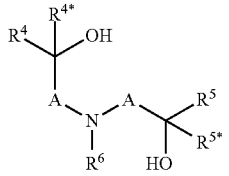

wherein A are independently selected from $C_1$-$C_6$-alkylene; $R^1$, $R^{1*}$, $R^2$, $R^{2*}$, $R^3$, $R^{3*}$, $R^4$, $R^{4*}$, $R^5$ and $R^{5*}$ are independently selected from hydrogen, alkyl, cycloalkyl or aryl, wherein the last three mentioned radicals may be optionally substituted; and $R^6$ is selected from hydrogen, alkyl, cycloalkyl or aryl, wherein the last three mentioned radicals may be optionally substituted.

The plurality of alkylenoxy groups attached to the core structure are independently selected from alkylenoxy units of the formula (V)

(V)

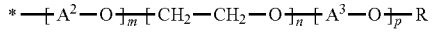

wherein * in each case denotes one-half of a bond to the nitrogen atom of the repeating unit of formula (I), (II) or (IV); $A^2$ is in each case independently selected from 1,2-propylene, 1,2-butylene and 1,2-isobutylene; $A^3$ is 1,2-propylene; R is in each case independently selected from hydrogen and $C_1$-$C_4$-alkyl; m has an average value in the range of from 0 to about 2; n has an average value in the range of from about 20 to about 50; and p has an average value in the range of from about 10 to about 50.

Specific embodiments of the amphiphilic alkoxylated grease cleaning polymers may be selected from alkoxylated polyalkylenimines having an inner polyethylene oxide block and an outer polypropylene oxide block, the degree of ethoxylation and the degree of propoxylation not going above or below specific limiting values. Specific embodiments of the alkoxylated polyalkylenimines according to the present invention have a minimum ratio of polyethylene) blocks to polypropylene blocks (n/p) of about 0.6 and a maximum of about $1.5(x+2y+1)^{1/2}$. Alkoxykated polyalkyenimines having an n/p ratio of from about 0.8 to about $1.2(x+2y+1)^{1/2}$ have been found to have especially beneficial properties.

The alkoxylated polyalkylenimines according to the present invention have a backbone which consists of primary, secondary and tertiary amine nitrogen atoms which are attached to one another by alkylene radicals A and are randomly arranged. Primary amino moieties which start or terminate the main chain and the side chains of the polyalkylenimine backbone and whose remaining hydrogen atoms are subsequently replaced by alkylenoxy units are referred to as repeating units of formulae (I) or (IV), respectively. Secondary amino moieties whose remaining hydrogen atom is subsequently replaced by alkylenoxy units are referred to as repeating units of formula (II). Tertiary amino moieties which branch the main chain and the side chains are referred to as repeating units of formula (III).

Since cyclization can occur in the formation of the polyalkylenimine backbone, it is also possible for cyclic amino moieties to be present to a small extent in the backbone. Such polyalkylenimines containing cyclic amino moieties are of course alkoxylated in the same way as those consisting of the noncyclic primary and secondary amino moieties.

The polyalkylenimine backbone consisting of the nitrogen atoms and the groups $A^1$, has an average molecular weight Mw of from about 60 to about 10,000 g/mole, preferably from about 100 to about 8,000 g/mole and more preferably from about 500 to about 6,000 g/mole.

The sum (x+2y+1) corresponds to the total number of alkylenimine units present in one individual polyalkylenimine backbone and thus is directly related to the molecular weight of the polyalkylenimine backbone. The values given in the specification however relate to the number average of all polyalkylenimines present in the mixture. The sum (x+2y+2) corresponds to the total number amino groups present in one individual polyalkylenimine backbone.

The radicals $A^1$ connecting the amino nitrogen atoms may be identical or different, linear or branched $C_2$-$C_6$-alkylene radicals, such as 1,2-ethylene, 1,2-propylene, 1,2-butylene, 1,2-isobutylene, 1,2-pentanediyl, 1,2-hexanediyl or hexamethylene. A preferred branched alkylene is 1,2-propylene. Preferred linear alkylene are ethylene and hexamethylene. A more preferred alkylene is 1,2-ethylene.

The hydrogen atoms of the primary and secondary amino groups of the polyalkylenimine backbone are replaced by alkylenoxy units of the formula (V).

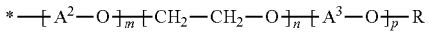

(V)

In this formula, the variables preferably have one of the meanings given below:

$A^2$ in each case is selected from 1,2-propylene, 1,2-butylene and 1,2-isobutylene; preferably $A^2$ is 1,2-propylene. $A^3$ is 1,2-propylene; R in each case is selected from hydrogen and $C_1$-$C_4$-alkyl, such as methyl, ethyl, n-propyl, isopropyl, n-butyl, isobutyl and tert.-butyl; preferably R is hydrogen. The index m in each case has a value of 0 to about 2; preferably m is 0 or approximately 1; more preferably m is 0. The index n has an average value in the range of from about 20 to about 50, preferably in the range of from about 22 to about 40, and more preferably in the range of from about 24 to about 30. The index p has an average value in the range of from about 10 to about 50, preferably in the range of from about 11 to about 40, and more preferably in the range of from about 12 to about 30.

Preferably the alkylenoxy unit of formula (V) is a non-random sequence of alkoxylate blocks. By non-random sequence it is meant that the $[-A^2-O—]_m$ is added first (i.e., closest to the bond to the nitrogen atom of the repeating unit of formula (I), (II), or (III)), the $[—CH_2—CH_2—O—]_n$ is added second, and the $[-A^3-O—]_p$ is added third. This orientation provides the alkoxylated polyalkylenimine with an inner polyethylene oxide block and an outer polypropylene oxide block.

The substantial part of these alkylenoxy units of formula (V) is formed by the ethylenoxy units $—[CH_2—CH_2—O)]_n—$ and the propylenoxy units $—[CH_2—CH_2(CH_3)—O]_p—$. The alkylenoxy units may additionally also have a small proportion of propylenoxy or butylenoxy units $-[A^2-O]_m—$, i.e. the polyalkylenimine backbone saturated with hydrogen atoms may be reacted initially with small amounts of up to about 2 mol, especially from about 0.5 to about 1.5 mol, in particular from about 0.8 to about 1.2 mol, of propylene oxide or butylene oxide per mole of NH— moieties present, i.e. incipiently alkoxylated.

This initial modification of the polyalkylenimine backbone allows, if necessary, the viscosity of the reaction mixture in the alkoxylation to be lowered. However, the modification generally does not influence the performance properties of the alkoxylated polyalkylenimine and therefore does not constitute a preferred measure.

The amphiphilic alkoxylated grease cleaning polymers are present in the detergent and cleaning compositions of the present invention at levels ranging from about 0.05% to 10% by weight of the composition. Embodiments of the compositions may comprise from about 0.1% to about 5% by weight. More specifically, the embodiments may comprise from about 0.25 to about 2.5% of the grease cleaning polymer.

Random Graft Co-Polymer.

Suitable random graft co-polymers typically comprise: (i) hydrophilic backbone comprising monomers selected from the group consisting of: unsaturated $C_1$-$C_6$ carboxylic acids, ethers, alcohols, aldehydes, ketones, esters, sugar units, alkoxy units, maleic anhydride, saturated polyalcohols such as glycerol, and mixtures thereof; and (ii) hydrophobic side chain(s) selected from the group consisting of: $C_4$-$C_{25}$ alkyl group, polypropylene, polybutylene, vinyl ester of a saturated $C_1$-$C_6$ mono-carboxylic acid, $C_1$-$C_6$ alkyl ester of acrylic or methacrylic acid, and mixtures thereof.

The polymer preferably has the general formula:

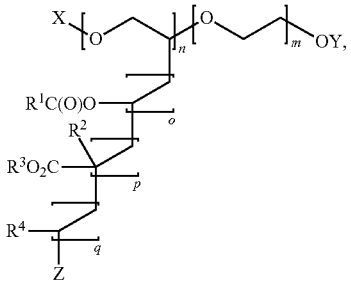

wherein X, Y and Z are capping units independently selected from H or a $C_{1-6}$ alkyl; each $R^1$ is independently selected from methyl and ethyl; each $R^2$ is independently selected from H and methyl; each $R^3$ is independently a $C_{1-4}$ alkyl; and each $R^4$ is independently selected from pyrrolidone and phenyl groups. The weight average molecular weight of the polyethylene oxide backbone is typically from about 1,000 g/mol to about 18,000 g/mol, or from about 3,000 g/mol to about 13,500 g/mol, or from about 4,000 g/mol to about 9,000 g/mol. The value of m, n, o, p and q is selected such that the pendant groups comprise, by weight of the polymer at least 50%, or from about 50% to about 98%, or from about 55% to about 95%, or from about 60% to about 90%. The polymer useful herein typically has a weight average molecular weight of from about 1,000 to about 100,000 g/mol, or preferably from about 2,500 g/mol to about 45,000 g/mol, or from about 7,500 g/mol to about 33,800 g/mol, or from about 10,000 g/mol to about 22,500 g/mol.

Other Polymers.

The composition preferably comprises polymer in addition to the surfactancy boosting polymers. Suitable other polymers include soil release polymers, anti-redeposition polymers, carboxylate polymers and/or deposition aid polymers. Other suitable polymers include dye transfer inhibitors, such as polyvinyl pyrrolidone polymer, polyamine N-oxide polymer, co-polymer of N-vinylpyrrolidone and N-vinylimidazole polymers.

Soil Release Polymers.

Suitable soil release polymers include polymers comprising at least one monomer unit selected from saccharide, dicarboxylic acid, polyol and combinations thereof, in random or block configuration. Other suitable soil release polymers include ethylene terephthalate-based polymers and co-polymers thereof, preferably co-polymers of ethylene terephthalate and polyethylene oxide in random or block configuration.

Anti-Redeposition Polymers.

The composition may comprise anti-redeposition polymer, preferably from 0.1 wt % to 10 wt % anti-redeposition polymer. Suitable anti-redeposition polymers include carboxylate polymers, such as polymers comprising at least one monomer selected from acrylic acid, maleic acid (or maleic anhydride), fumaric acid, itaconic acid, aconitic acid, mesaconic acid, citraconic acid, methylenemalonic acid, and any mixture thereof. Suitable carboxylate polymers include.

Other suitable anti-redeposition polymers include polyethylene glycol, preferably having a molecular weight in the range of from 500 to 100,000 Da.

Carboxylate Polymers.

It may be preferred for the composition to comprise from above 0 wt % to 5 wt %, by weight of the composition, of polymeric carboxylate. The polymeric carboxylate can sequester free calcium ions in the wash liquor. The carboxylate polymers can also act as soil dispersants and can provide an improved particulate stain removal cleaning benefit.

The composition preferably comprises polymeric carboxylate. Preferred polymeric carboxylates include: polyacrylates, preferably having a weight average molecular weight of from 1,000 Da to 20,000 Da; co-polymers of maleic acid and acrylic acid, preferably having a molar ratio of maleic acid monomers to acrylic acid monomers of from 1:1 to 1:10 and a weight average molecular weight of from 10,000 Da to 200,000 Da, or preferably having a molar ratio of maleic acid monomers to acrylic acid monomers of from 0.3:1 to 3:1 and a weight average molecular weight of from 1,000 Da to 50,000 Da.

Deposition Aids.

The composition may comprise deposition aid. Suitable deposition aids are polysaccharides, preferably cellulosic polymers. Other suitable deposition aids include poly diallyl dimethyl ammonium halides (DADMAC), and co-polymers of DADMAC with vinyl pyrrolidone, acrylamides, imidazoles, imidazolinium halides, and mixtures thereof, in random or block configuration. Other suitable deposition aids include cationic guar gum, cationic cellulose such as cationic hydroxyethyl cellulose, cationic starch, cationic polyacylamides, and mixtures thereof.

Non-Polymeric Dye Transfer Inhibitors.

Non-polymeric dye transfer inhibitors may also be used, such as manganese phthalocyanine, peroxidases, and mixtures thereof.

Chelant.

Chelant may be but are not limited to the following: ethylene-diamine-tetraacetic acid (EDTA); diethylene triamine penta methylene phosphonic acid (DTPMP); hydroxy-ethane diphosphonic acid (HEDP); ethylenediamine N,N'-disuccinic acid (EDDS); methyl glycine di-acetic acid (MGDA); diethylene triamine penta acetic acid (DTPA); propylene diamine tetracetic acid (PDTA); 2-hydroxypyridine-N-oxide (HPNO); or methyl glycine diacetic acid (MGDA); glutamic acid N,N-diacetic acid (N,N-dicarboxymethyl glutamic acid tetrasodium salt (GLDA); nitrilotriacetic acid (NTA); 4,5-dihydroxy-m-benzenedisulfonic acid; citric acid; and any salts thereof.

The chelant are typically present at a level of from 0.1 wt % to 10 wt % by weight in the composition. The chelant may be in form of a solid particle that is suspended in the liquid composition.

Hueing Dyes.

The composition may comprise hueing dye. Hueing dyes are formulated to deposit onto fabrics from the wash liquor so as to improve fabric whiteness perception. Preferably the hueing agent dye is blue or violet. It is preferred that the shading dye(s) have a peak absorption wavelength of from 550 nm to 650 nm, preferably from 570 nm to 630 nm. A combination of dyes which together have the visual effect on the human eye as a single dye having a peak absorption wavelength on polyester of from 550 nm to 650 nm, preferably from 570 nm to 630 nm. This may be provided for example by mixing a red and green-blue dye to yield a blue or violet shade.

Dyes are coloured organic molecules which are soluble in aqueous media that contain surfactants. Dyes are described in 'Industrial Dyes', Wiley VCH 2002, K. Hunger (editor). Dyes are listed in the Color Index International published by Society of Dyers and Colourists and the American Association of Textile Chemists and Colorists. Dyes are preferably selected from the classes of basic, acid, hydrophobic, direct and polymeric dyes, and dye-conjugates. Those skilled in the art of detergent formulation are able to select suitable hueing dyes from these publications. Polymeric hueing dyes are commercially available, for example from Milliken, Spartanburg, S.C., USA.

Examples of suitable dyes are direct violet 7, direct violet 9, direct violet 11, direct violet 26, direct violet 31, direct violet 35, direct violet 40, direct violet 41, direct violet 51, direct violet 66, direct violet 99, acid violet 50, acid blue 9, acid violet 17, acid black 1, acid red 17, acid blue 29, solvent violet 13, disperse violet 27 disperse violet 26, disperse violet 28, disperse violet 63 and disperse violet 77, basic blue 16, basic blue 65, basic blue 66, basic blue 67, basic blue 71, basic blue 159, basic violet 19, basic violet 35, basic violet 38, basic violet 48; basic blue 3, basic blue 75, basic blue 95, basic blue 122, basic blue 124, basic blue 141, thiazolium dyes, reactive blue 19, reactive blue 163, reactive blue 182, reactive blue 96, Liquitint® Violet CT (Milliken, Spartanburg, USA) and Azo-CM-Cellulose (Megazyme, Bray, Republic of Ireland).

Enzymes.

The composition preferably comprises enzyme. Preferably, the composition comprises a relatively high level of enzymes. Most preferably, the composition comprises at least 0.01 wt % active enzyme. It may be preferred for the composition to comprise at least 0.03 wt % active enzyme.

It may be preferred for the composition to comprise at least a ternary enzyme system selected from protease, amylase, lipase and/or cellulase.

Lipase.

Suitable lipases include those of bacterial or fungal origin. Chemically modified or protein engineered mutants are included. Examples of useful lipases include lipases from *Humicola* (synonym *Thermomyces*), e.g., from *H. lanuginosa* (*T. lanuginosus*) as described in EP 258 068 and EP 305 216 or from *H. insolens* as described in WO 96/13580, a *Pseudomonas* lipase, e.g., from *P. alcaligenes* or *P. pseudoalcaligenes* (EP 218 272), *P. cepacia* (EP 331 376), *P. stutzeri* (GB 1,372,034), *P. fluorescens, Pseudomonas* sp. strain SD 705 (WO 95/06720 and WO 96/27002), *P. wisconsinensis* (WO 96/12012), a *Bacillus* lipase, e.g., from *B. subtilis* (Dartois et al. (1993), Biochemica et Biophysica Acta, 1131, 253-360), *B. stearothermophilus* (JP 64/744992) or *B. pumilus* (WO 91/16422).

The lipase may be a "first cycle lipase" such as those described in U.S. Pat. No. 6,939,702 and US PA 2009/0217464. In one aspect, the lipase is a first-wash lipase, preferably a variant of the wild-type lipase from *Thermomy-*

*ces lanuginosus* comprising T231R and N233R mutations. The wild-type sequence is the 269 amino acids (amino acids 23-291) of the Swissprot accession number Swiss-Prot O59952 (derived from *Thermomyces lanuginosus* (*Humicola lanuginosa*)). Preferred lipases would include those sold under the tradenames Lipex®, Lipolex® and Lipoclean® by Novozymes, Bagsvaerd, Denmark.

Preferably, the composition comprises a variant of *Thermomyces lanuginosa* lipase having >90% identity with the wild type amino acid and comprising substitution(s) at T231 and/or N233, preferably T231R and/or N233R (herein: "first wash lipase").

Protease.

Suitable proteases include metalloproteases and/or serine proteases, including neutral or alkaline microbial serine proteases, such as subtilisins (EC 3.4.21.62). Suitable proteases include those of animal, vegetable or microbial origin. In one aspect, such suitable protease may be of microbial origin. The suitable proteases include chemically or genetically modified mutants of the aforementioned suitable proteases. In one aspect, the suitable protease may be a serine protease, such as an alkaline microbial protease or/and a trypsin-type protease. Examples of suitable neutral or alkaline proteases include:

(a) subtilisins (EC 3.4.21.62), including those derived from *Bacillus*, such as *Bacillus lentos, B. alkalophilus, B. subtilis, B. amyloliquefaciens, Bacillus pumilus* and *Bacillus gibsonii* described in U.S. Pat. No. 6,312,936, U.S. Pat. No. 5,679,630, U.S. Pat. No. 4,760,025, U.S. Pat. No. 7,262,042 and WO09/021,867.

(b) trypsin-type or chymotrypsin-type proteases, such as trypsin (e.g., of porcine or bovine origin), including the *Fusarium* protease described in WO 89/06270 and the chymotrypsin proteases derived from *Cellumonas* described in WO 05/052161 and WO 05/052146.

(c) metalloproteases, including those derived from *Bacillus amyloliquefaciens* described in WO 07/044,993.

Preferred proteases include those derived from *Bacillus gibsonii* or *Bacillus Lentus.*

Suitable commercially available protease enzymes include those sold under the trade names Alcalase®, Savinase®, Primase®, Durazym®, Polarzyme®, Kannase®, Liquanase®, Liquanase Ultra®, Savinase Ultra®, Ovozyme®, Neutrase®, Everlase® and Esperase® by Novozymes A/S (Denmark), those sold under the tradename Maxatase®, Maxacal®, Maxapem®, Properase®, Purafect®, Purafect Prime®, Purafect Ox®, FN3®, FN4®, Excellase® and Purafect OXP® by Genencor International, those sold under the tradename Opticlean® and Optimase® by Solvay Enzymes, those available from Henkel/Kemira, namely BLAP (sequence shown in FIG. 29 of U.S. Pat. No. 5,352,604 with the following mutations S99D+S101 R+S103A+V104I+G159S, hereinafter referred to as BLAP), BLAP R (BLAP with S3T+V4I+V199M+V205I+L217D), BLAP X (BLAP with S3T+V4I+V205I) and BLAP F49 (BLAP with S3T+V4I+A194P+V199M+V205I+L217D)—all from Henkel/Kemira; and KAP (*Bacillus alkalophilus* subtilisin with mutations A230V+S256G+S259N) from Kao.

Preferably, the composition comprises a subtilisin protease selected from BLAP, BLAP R, BLAP X or BLAP F49.

Cellulase.

Suitable cellulases include those of bacterial or fungal origin. Chemically modified or protein engineered mutants are included. Suitable cellulases include cellulases from the genera *Bacillus, Pseudomonas, Humicola, Fusarium, Thielavia, Acremonium*, e.g., the fungal cellulases produced from *Humicola insolens, Myceliophthora thermophila* and *Fusarium oxysporum* disclosed in U.S. Pat. No. 4,435,307, U.S. Pat. No. 5,648,263, U.S. Pat. No. 5,691,178, U.S. Pat. No. 5,776,757 and WO 89/09259.

In one aspect, the cellulase can include microbial-derived endoglucanases exhibiting endo-beta-1,4-glucanase activity (E.C. 3.2.1.4), including a bacterial polypeptide endogenous to a member of the genus *Bacillus* which has a sequence of at least 90%, 94%, 97% and even 99% identity to the amino acid sequence SEQ ID NO:2 in U.S. Pat. No. 7,141,403 and mixtures thereof. A suitable endoglucanases is sold under the tradename Celluclean® (Novozymes A/S, Bagsvaerd, Denmark). Further suitable endoglucanases are variants of the XYG1006 enzyme described in U.S. Pat. No. 7,361,736 (Novozymes). A suitable endoglucanase is sold under the tradename Whitezyme®(Novozymes A/S, Bagsvaerd, Denmark).

Preferably, the composition comprises a cleaning cellulase belonging to Glycosyl Hydrolase family 45 having a molecular weight of from 17 kDa to 30 kDa, for example the endoglucanases sold under the tradename Biotouch® NCD, DCC and DCL (AB Enzymes, Darmstadt, Germany).

Amylase.

Preferably, the composition comprises an amylase with greater than 60% identity to the AA560 alpha amylase endogenous to *Bacillus* sp. DSM 12649, preferably a variant of the AA560 alpha amylase endogenous to *Bacillus* sp. DSM 12649 having:

(a) mutations at one or more of positions 9, 26, 149, 182, 186, 202, 257, 295, 299, 323, 339 and 345; and (b) optionally with one or more, preferably all of the substitutions and/or deletions in the following positions: 118, 183, 184, 195, 320 and 458, which if present preferably comprise R118K, D183*, G184*, N195F, R320K and/or R458K.

Suitable commercially available amylase enzymes include Stainzyme® Plus, Stainzyme®, Natalase, Termamyl®, Termamyl® Ultra, Liquezyme® SZ (all Novozymes, Bagsvaerd, Denmark) and Spezyme® AA or Ultraphlow (Genencor, Palo Alto, USA).

Choline Oxidase.

Preferably, the composition comprises a choline oxidase enzyme such as the 59.1 kDa choline oxidase enzyme endogenous to *Arthrobacter nicotianae*, produced using the techniques disclosed in D. Ribitsch et al., Applied Microbiology and Biotechnology, Volume 81, Number 5, pp 875-886, (2009).

Other Enzymes.

Other suitable enzymes are peroxidases/oxidases, which include those of plant, bacterial or fungal origin. Chemically modified or protein engineered mutants are included. Examples of useful peroxidases include peroxidases from *Coprinus*, e.g., from *C. cinereus*, and variants thereof as those described in WO 93/24618, WO 95/10602, and WO 98/15257.

Commercially available peroxidases include GUARDZYME® (Novozymes A/S).

Other preferred enzymes include: pectate lyases sold under the tradenames Pectawash®, Pectaway®; mannanases sold under the tradenames Mannaway® (all from Novozymes A/S, Bagsvaerd, Denmark), and Purabrite® (Genencor International Inc., Palo Alto, Calif.); cutinases; phospholipases; and any mixture thereof.

Identity.

The relativity between two amino acid sequences is described by the parameter "identity". For purposes of the present invention, the alignment of two amino acid sequences is determined by using the Needle program from the EMBOSS package (http://emboss.org) version 2.8.0. The Needle program implements the global alignment algorithm described in Needleman, S. B. and Wunsch, C. D. (1970) J.

Mol. Biol. 48, 443-453. The substitution matrix used is BLOSUM62, gap opening penalty is 10, and gap extension penalty is 0.5.

Enzyme Stabilizer.

The composition may comprise an enzyme stabilizer. Suitable enzyme stabilizers include polyols such as propylene glycol or glycerol, sugar or sugar alcohol, lactic acid, reversible protease inhibitor, boric acid, or a boric acid derivative, e.g., an aromatic borate ester, or a phenyl boronic acid derivative such as 4-formylphenyl boronic acid. It may be preferred for the composition to comprise a nil-boron enzyme stabilizer, preferably selected from polyols such as propylene glycol or glycerol, sugar or sugar alcohol. It may even be preferred for the composition to be substantially free of boron. By substantially free it is typically meant: "comprises no deliberately added". Free of boron also typically includes being free of sources of boron such as borax.

Calcium and Magnesium Cations.

Preferably, the composition comprises from at least 0.2 wt % to 5 wt % calcium and/or magnesium cations.

Visual Signaling Ingredients.

Suitable visual signaling ingredients include any reflective and/or refractive material, preferably mica.

Anti-Foam.

The detergent compositions herein comprise from about 0.001 wt % to about 4.0 wt % anti-foam selected from silicone anti-foam compounds; anti-foam compounds of silicone oils and hydrophobic particles; and mixtures thereof. In one embodiment, the compositions herein comprise from about 0.01 wt % to about 2.0 wt %, alternatively from 0.05 wt % to about 1.0 wt % silicone anti-foam (percentages by active amount not including any carrier).

In one embodiment, the anti-foam is selected from: organomodified silicone polymers with aryl or alkylaryl substituents combined with silicone resin and modified silica; M/Q resins; and mixtures thereof.

Fatty Acid.

The composition comprises from 0 wt % to 10 wt %, preferably from 0 wt % to 5 wt %, preferably from 0.1 wt % to 5 wt %, preferably from 0.5 wt % to 3 wt % saturated or unsaturated fatty acid, preferably saturated or unsaturated $C_{12}$-$C_{24}$ fatty acid; highly preferred are saturated $C_{12}$-$C_{18}$ fatty acid.

Structurant/Thickener.

Structured liquids can either be internally structured, whereby the structure is formed by primary ingredients (e.g. surfactant material) and/or externally structured by providing a three dimensional matrix structure using secondary ingredients (e.g. polymers, clay and/or silicate material).

The composition may comprise a structurant, preferably from 0.01 wt % to 5 wt %, from 0.1 wt % to 2.0 wt % structurant. The structurant is typically selected from the group consisting of diglycerides and triglycerides, ethylene glycol distearate, microcrystalline cellulose, cellulose-based materials, microfiber cellulose, biopolymers, xanthan gum, gellan gum, and mixtures thereof. A suitable structurant includes hydrogenated castor oil, and non-ethoxylated derivatives thereof. It may be preferred for the composition to substantially free of lipase, by substantially free it is typically meant: "comprises no deliberately added". This is especially preferred when the composition comprises hydrogenated castor oil, and non-ethoxylated derivatives thereof. A suitable structurant is U.S. Pat. No. 6,855,680, such structurants have a thread-like structuring system having a range of aspect ratios. Other suitable structurants and the processes for making them are described in WO2010/034736.

Ethylene glycol distearate can also be used as a visual signaling ingredient.

Fatty Alcohol Gel Network.

It may be preferred for the composition to comprise a first wash lipase, especially preferably in combination with a gel network, such as a fatty alcohol gel network. Gel networks are described in WO09/120,854, WO08/127,861, WO07/040,571 and WO00/036078. $C_8$-$C_{12}$ fatty alcohol, such as dodecanol, fatty alcohol gel networks are particularly suitable. Alternatively, gum gel networks can also be used.

Solvent.

The composition preferably comprises solvent. Preferred solvents include alcohols and/or glycols, preferably methanol, ethanol and/or propylene glycol. Preferably, the composition comprises no or minimal amounts of methanol and ethanol and instead comprises relatively high amounts of propylene glycol, for improved enzyme stability. Preferably, the composition comprises propylene glycol.

Suitable solvents include $C_4$-$C_{14}$ ethers and diethers, glycols, alkoxylated glycols, $C_6$-$C_{16}$ glycol ethers, alkoxylated aromatic alcohols, aromatic alcohols, aliphatic branched alcohols, alkoxylated aliphatic branched alcohols, alkoxylated linear $C_1$-$C_5$ alcohols, linear $C_1$-$C_5$ alcohols, amines, $C_8$-$C_{14}$ alkyl and cycloalkyl hydrocarbons and halohydrocarbons, and mixtures thereof.

Preferred solvents are selected from methoxy octadecanol, 2-(2-ethoxyethoxy)ethanol, benzyl alcohol, 2-ethylbutanol and/or 2-methylbutanol, 1-methylpropoxyethanol and/or 2-methylbutoxyethanol, linear $C_1$-$C_5$ alcohols such as methanol, ethanol, propanol, butyl diglycol ether (BDGE), butyltriglycol ether, tert-amyl alcohol, glycerol, isopropanol and mixtures thereof. Particularly preferred solvents which can be used herein are butoxy propoxy propanol, butyl diglycol ether, benzyl alcohol, butoxypropanol, propylene glycol, glycerol, ethanol, methanol, isopropanol and mixtures thereof. Other suitable solvents include propylene glycol and diethylene glycol and mixtures thereof.

Electrolytic Strength.

The electrolytic strength of the composition at a concentration of 1 g/l in de-ionized water and at a temperature of 25° C. in $mScm^{-1}$ is preferably less than 200 $mScm^{-1}$, more preferably less than 150 $mScm^{-1}$, even more preferably less than 100 $mScm^{-1}$, and even less than 75 $mScm^{-1}$, or even less than 50 $mScm^{-1}$. The electrolytic strength can be determined by any suitable means, such as conductivity meter.

Buffers.

The composition typically comprises buffer. Preferred buffers include mono-ethanolamine (MEA) and tri-ethanolamine (TEA). Borax may be used as a buffer, although preferably the composition is substantially free of borax, by substantially free it is typically meant no deliberately added borax is incorporated into the composition.

Alkanolammonium Cation.

Preferably, the composition comprises alkanolammonium cation, preferably mono-ethanolamine (MEA) and/or triethanolamine (TEA).

Hydrotropes.

The composition may comprise hydrotrope. A preferred hydrotrope is monopropylene glycol.

Free Water.

The composition preferably comprises less than 10 wt %, or less than 5 wt %, or less than 4 wt % or less than 3 wt % free water, or less than 2 wt % free water, or less than 1 wt % free water, and may even be anhydrous, typically comprising no deliberately added free water. Free water is typically measured using Karl Fischer titration. 2 g of the laundry detergent composition is extracted into 50 ml dry methanol at room temperature for 20 minutes and analyse 1 ml of the methanol by Karl Fischer titration.

Remarks.

The dimensions and values disclosed herein are not to be understood as being strictly limited to the exact numerical values recited. Instead, unless otherwise specified, each such dimension is intended to mean both the recited value and a functionally equivalent range surrounding that value. For example, a dimension disclosed as "40 mm" is intended to mean "about 40 mm."

Every document cited herein, including any cross referenced or related patent or application, is hereby incorporated herein by reference in its entirety unless expressly excluded or otherwise limited. The citation of any document is not an admission that it is prior art with respect to any invention disclosed or claimed herein or that it alone, or in any combination with any other reference or references, teaches, suggests or discloses any such invention. Further, to the extent that any meaning or definition of a term in this document conflicts with any meaning or definition of the same term in a document incorporated by reference, the meaning or definition assigned to that term in this document shall govern.

While particular embodiments of the present invention have been illustrated and described, it would be obvious to those skilled in the art that various other changes and modifications can be made without departing from the spirit and scope of the invention. It is therefore intended to cover in the appended claims all such changes and modifications that are within the scope of this invention.

EXAMPLES

| Ingredient | wt % |
|---|---|
| Linear alkyl benzene sulphonic acid (HLAS) | 11 |
| C1214 alkyl ethoxylated alcohol having an average degree of ethoxylation of 9 (AE9) | 2 |
| C1214 alkyl ethoxylated sulphonic acid having an average degree of ethoxylation of 3 (HAES) | 23 |
| C1617 alkyl mid chain branched alkyl sulphate | 4 |
| Amine oxide | 1 |
| C1218 fatty acid | 2 |
| Protease | 2 |
| Natalase | 0.9 |
| PE20 polymer | 3 |
| Polyethylene imine polymer | 3 |
| Chelant | 1.4 |
| FWA 15 Brightener | 0.4 |
| p-glycol | 8 |
| DEG | 0.5 |
| Ethanol | 3 |
| Monoethanolamine | 6 |
| Water | 26 |
| NaOH | 0.3 |
| Perfume | 1 |
| Silicone suds suppressor | 0.06 |
| Violet DD dye | 0.01 |
| Other dyes | 0.03 |
| Hydrogenated castor oil | 0.1 |
| Mica | 0.2 |
| Calcium formate | 0.1 |
| Sodium formate | 0.2 |
| Miscellaneous | to 100 |

The dimensions and values disclosed herein are not to be understood as being strictly limited to the exact numerical values recited. Instead, unless otherwise specified, each such dimension is intended to mean both the recited value and a functionally equivalent range surrounding that value. For example, a dimension disclosed as "40 mm" is intended to mean "about 40 mm".

Every document cited herein, including any cross referenced or related patent or application, is hereby incorporated herein by reference in its entirety unless expressly excluded or otherwise limited. The citation of any document is not an admission that it is prior art with respect to any invention disclosed or claimed herein or that it alone, or in any combination with any other reference or references, teaches, suggests or discloses any such invention. Further, to the extent that any meaning or definition of a term in this document conflicts with any meaning or definition of the same term in a document incorporated by reference, the meaning or definition assigned to that term in this document shall govern.

While particular embodiments of the present invention have been illustrated and described, it would be obvious to those skilled in the art that various other changes and modifications can be made without departing from the spirit and scope of the invention. It is therefore intended to cover in the appended claims all such changes and modifications that are within the scope of this invention.

What is claimed is:

1. A method of laundering fabric comprising the step of contacting a liquid laundry detergent composition to water to form a wash liquor, and laundering fabric in said wash liquor, wherein the laundry detergent composition is contacted to water in such an amount so that the concentration of the laundry detergent composition in the wash liquor is from above 0 g/l to 4 g/l, and wherein from 0.01 kg to 2 kg of fabric per liter of wash liquor is dosed into said wash liquor, and wherein the liquid laundry detergent composition comprises:

(i) detersive surfactant comprising anionic detersive surfactant and non-ionic surfactant, wherein the weight ratio of anionic detersive surfactant to non-ionic detersive surfactant is greater than 1:1, and wherein the composition comprises from 18 wt % to 40 wt % detersive surfactant;

(ii) surfactancy boosting polymer;

(iii) silicone suds suppressor;

(iv) structurant, wherein the structurant comprises a fatty alcohol gel network;

(v) enzyme, wherein the enzyme comprises a variant of *Thermomyces lanuginosa* lipase having >90% identity with the wild type amino acid and comprises substitution(s) at T231 and/or N233; and (vi) nil-boron enzyme stabilizer, wherein the nil-boron enzyme stabilizer is lactic acid;

wherein the electrolytic strength of the composition at a concentration of 1 g/l in de-ionized water and at a temperature of 25° C. in $mScm^{-1}$ is less than 200 $mScm^{-1}$, and wherein the composition is substantially free of boron.

2. The method according to claim 1, wherein the fabric is laundered in said wash liquor at a temperature of 20° C. or less.

3. The method according to claim 1, wherein the composition further comprises an alkanolammonium cation.

4. The method according to claim 1, wherein the composition further comprises tertiary alkanolamine having a pKa of less than 9.0.

5. The method according to claim 1, wherein at least 60 wt % of the anionic detersive surfactant is neutralized by a sodium cation.

6. The method according to claim 1, wherein the anionic detersive surfactant has a hydrophilic index ($HI_C$) of from 8.0 to 9.1.

7. The method according to claim 1, wherein the detersive surfactant comprising anionic surfactant and nonionic surfactant comprises branched anionic detersive surfactant and/or branched non-ionic detersive surfactant.

8. The method according to claim 7, wherein the branched anionic detersive surfactant and/or branched non-ionic detersive surfactant are derived from natural sources.

9. The method according to claim 1, wherein the composition comprises from at least 0.2 wt % to 5 wt % calcium and/or magnesium cations.

10. The method according to claim 1, wherein the enzyme comprises active enzyme, wherein the composition comprises at least 0.01 wt % active enzyme.

11. The method according to claim 1, wherein the enzyme comprises at least a ternary enzyme system selected from protease, amylase, lipase and/or cellulase.

12. The method according to claim 1, wherein the enzyme comprises an enzyme exhibiting endo-beta-1,4-glucanase activity.

13. The method according to claim 1, wherein the enzyme comprises an amylase with greater than 60% identity to the AA560 alpha amylase endogenous to *Bacillus* sp. DSM 12649, having:

(a) mutations at one or more of positions 9, 26, 149, 182, 186, 202, 257, 295, 299, 323, 339 and 345; and (b) optionally with one or more, the substitutions and/or deletions in the following positions: 118, 183, 184, 195, 320 and 458.

14. The method according to claim 1, wherein the surfactancy boosting polymer is an amphiphilic alkoxylated grease cleaning polymer and/or random graft co-polymer.

15. The method according to claim 1, wherein the composition comprises from 0.1 wt % to 5 wt % fatty acid.

* * * * *